United States Patent [19]

Skiles, Jr.

[11] Patent Number: 5,010,592

[45] Date of Patent: Apr. 30, 1991

[54] SELF-STORING COAT

[75] Inventor: John R. Skiles, Jr., Dallas, Tex.

[73] Assignee: Ol'Sonora Trading Company Inc., Sonora, Tex.

[21] Appl. No.: 354,638

[22] Filed: May 19, 1989

[51] Int. Cl.[5] ..... A41D 3/00; A41D 15/00

[52] U.S. Cl. ..... 2/93; 2/108; 2/247; 2/250

[58] Field of Search ..... 2/93, 94, 95, 108, 247, 2/249, 250, 253

[56] References Cited

U.S. PATENT DOCUMENTS

| | | | |
|---|---|---|---|
| 2,142,814 | 1/1939 | Fitch | 2/93 |
| 2,143,931 | 1/1939 | Aronbon | 2/93 |
| 2,292,347 | 8/1942 | Bailey | 2/93 |
| 4,055,853 | 11/1977 | Argento et al. | 2/93 |
| 4,404,687 | 9/1983 | Hager | 2/94 |
| 4,502,154 | 3/1985 | Itoi | 2/108 |
| 4,689,831 | 9/1987 | Greenberger et al. | 2/93 |
| 4,700,409 | 10/1987 | DeLott | 2/94 |
| 4,862,520 | 9/1989 | Gazzola | 2/93 |

*Primary Examiner*—Werner H. Schroeder
*Assistant Examiner*—Gloria Hale
*Attorney, Agent, or Firm*—Johnson & Gibbs

[57] ABSTRACT

A self storing coat having a coat body or shell and a lining including a storage pocket attached to the lining between the lining and the inside back of the coat, the lining having a longitudinal opening into the storage pocket with fabric fastener strips along the opening for releasably holding the opening closed when wearing the coat and when the coat is stored in the pocket, the coat and lining being foldable in halves and reverse foldable into the lining storage pocket which is turned wrong side out over the folded coat halves, so that the coat is stored within the reversed pocket and the fabric strips close the opening into the pocket forming a package containing the coat, the outer surfaces of the packages being the normal inside surfaces of the storage pocket when the coat is in normal wearing mode.

7 Claims, 3 Drawing Sheets

SELF-STORING COAT

FIELD OF THE INVENTION

This invention relates to coats, and more particularly, relates to self-storing coats having an integral internal pocket into which the coat is foldable for travel and storage.

HISTORY OF THE PRIOR ART

An extremely wide variety of coats have been made throughout history for protecting a wearer against cold weather, and other inclement weather such as rain, wind, snow, and the like. Such coats have been made in a wide variety of materials, both natural and synthetic, and with or without a lining. Generally, with the exception of raincoats, such coats have not included features for folding into a protected form for travel and storage. Some lightweight raincoats are provided with a separate storage bag for the coat when not in use. Self-storing coats having an integral hidden storage bag or pocket for protecting the coat during travel and when not in use are not known to have been available.

SUMMARY OF THE INVENTION

It is an object of the invention to provide a new and improved coat.

It is another object of the invention to provide a new and improved self-storing coat having an integral storage bag or pocket into which the coat may be folded for travel and storage.

It is another object of the invention to provide a coat of the character described including an internal hidden pocket into which the coat is foldable and which is not visible when the coat is worn.

It is another object of the invention to provide a coat having an internal lining including a storage pocket into which the coat may be reversed folded for protection during travel and during storage of the coat.

It is still further object of the invention to provide a new and improved coat which includes an integral pocket into which the coat may be folded providing a small compact package for travel.

It is another object of the invention to provide a coat having an internal pocket into which the coat body and the lining may be folded to form a pillow-like package.

It is another object of the invention to provide a coat having an integral internal pocket into which the coat body and the lining may be folded to protect the coat for storage.

In accordance with the invention, there is provided a self-storing coat having lining provided with an internal pocket secured with a back portion of the lining between the lining and the inside face of the coat body along the back of the coat, and an opening along the back of the lining including opening securing structure to permit access into the pocket for reverse folding the coat body and the lining into the pocket. The pocket is turned wrong side out and serves as a bag for the coat body and lining. The invention is adaptable to any style and length coat having a lining and made of any desired materials.

BRIEF DESCRIPTION OF THE DRAWINGS

The foregoing objects and advantages and a preferred embodiment of the invention will be understood from the following detailed description thereof taken in conjunction with the accompanying drawings wherein.

DESCRIPTION OF THE PREFERRED EMBODIMENT

Figure 3:
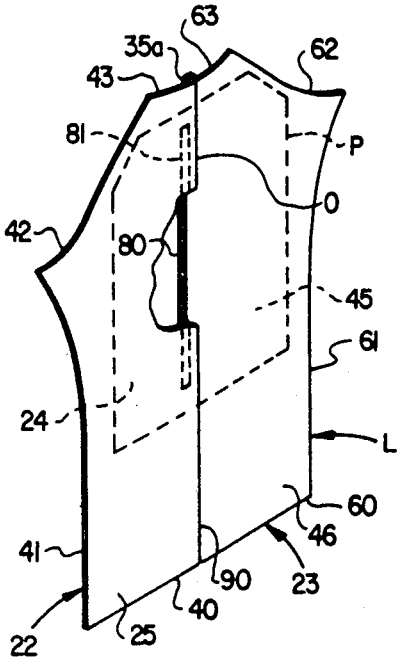
FIG. 3 is a front perspective of the assembled pocket and lining parts illustrated in FIG. 2 showing the coat storage pocket closed.

Referring to the drawings, there is provided a coat C having a lining which includes a back and side panel assembly L, FIG. 3, with a storage pocket P along the back face of the panel assembly L within the back of the coat body B, a longitudinal access opening O along the front of the panel assembly L extending the length of the pocket P to provide access into the pocket. The coat body B is broadly defined as the outer shell of the coat including the back, sides, front, and sleeves all of which may be lined to include the lining assembly L. In accordance with the invention, the coat can be folded and turned wrong side out into the pocket to provide a compact pillow-like package fully encased within the pocket. The pocket P is completely hidden between the back of the lining assembly L and the inside back of the coat body. During normal use of the coat, the pocket opening is sealed by fastening strips making the pocket totally invisible during normal wear.

Figure 1:
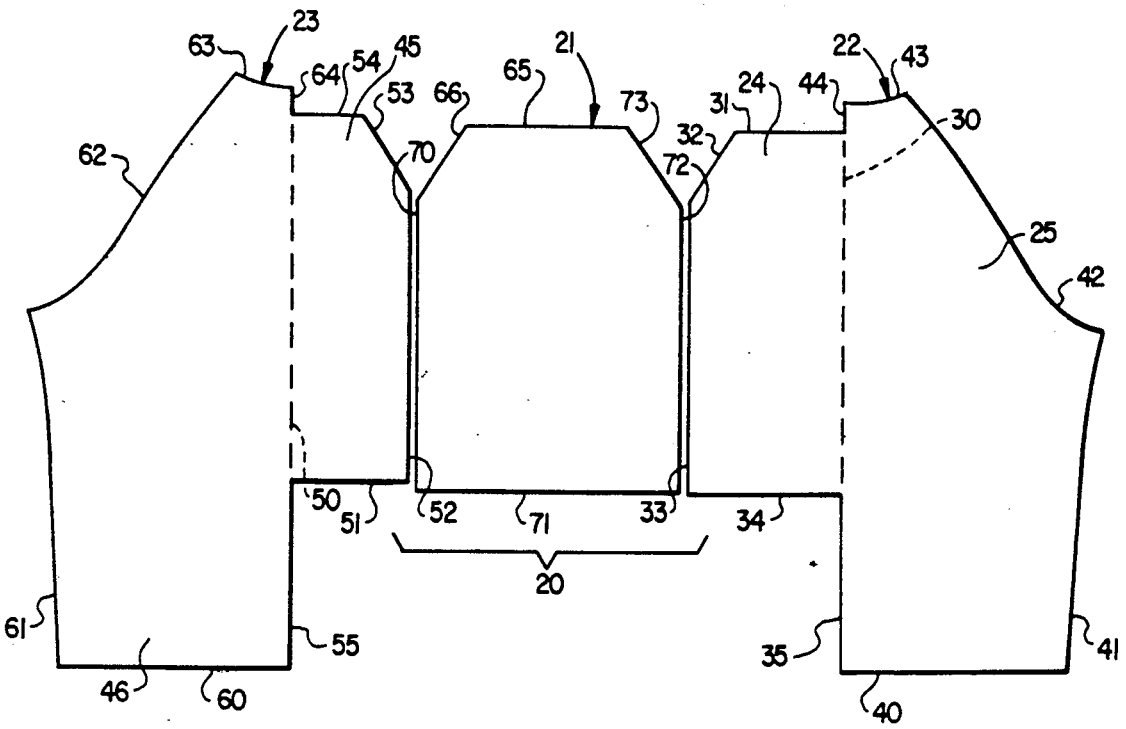
FIG. 1 is an exploded plan view of the coat lining and pocket panels which are secured together to form the coat storage pocket and back side panels of the lining of a coat constructed in accordance with the invention.

Referring FIG. 1, a pocket and lining panel assembly 20 for forming the back and side portions of a coat lining having a storage pocket in accordance with the invention includes a storage pocket back panel 21, a right coat lining panel 22, and a left coat lining back panel 23. The lining panel 22 includes a longitudinal section 24 and a longitudinal section 25 formed integral with the section 24 along a fold line 30. The section 24 forms the right front of one side of the coat storage pocket P. The section 25 defines the right half of the back and a side portion of the lining of the coat of the invention. The section 24 is defined by panel edges 31, 32, 33, and 34 and the fold line 30. The panel section 25 is defined by the fold line 30 and panel edges 35, 40, 41, 42, 43, and 44. Similarly, the left lining panel 23 includes a longitudinal section 45 and a longitudinal section 46 joined with the section 45 along a fold line 50. The panel section 45 is defined by the fold line 50 and panel edges 51, 52, 53, and 54. The panel section 46 is defined by the fold line 50 and the panel edges 55, 60, 61, 62, 63, and 64. The left panel section 45 forms the front of the left side of the storage pocket while the panel section 46 forms the left back and a side portion of the coat lining. The back panel 21 of the pocket is defined by a top edge 65, side edges 65 and 70, a bottom edge 71, and side edges 72 and 73.

Figure 2:
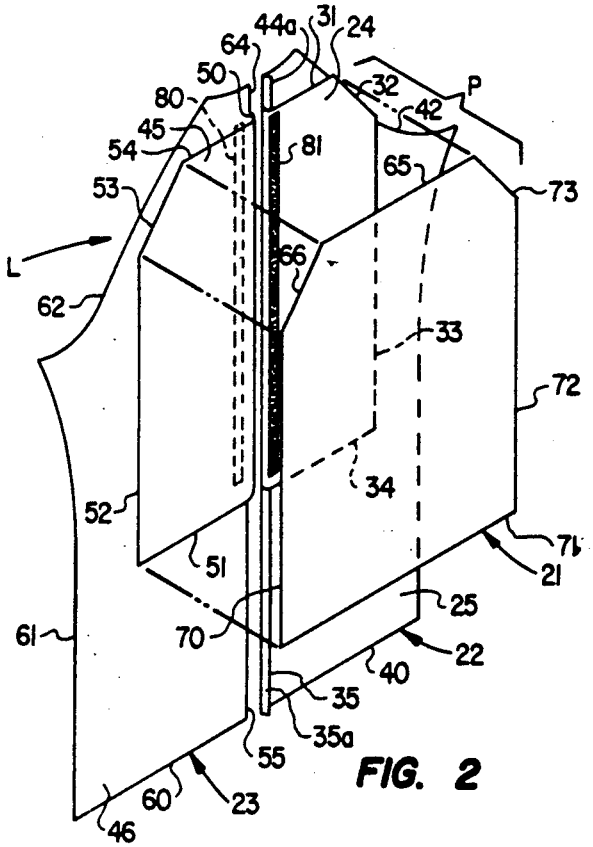
FIG. 2 is a exploded perspective back view of the pocket and lining parts shown in FIG. 1 during assembly prior to securing the lining and pocket inside of a coat.

The lining assembly L including the pocket P is made by sewing the panel assembly 20 together in a series of steps illustrated schematically in FIG. 2 and as completed in FIG. 3. In following the assembly steps, it must be kept in mind that FIG. 2 shows the back of the lining assembly L while FIG. 3 is showing the lining assembly L from the front after completion of the lining assembly preliminary to sewing it in the coat body B. Referring to FIGS. 1 and 2, the lining panel section 24 is folded backwardly, toward the viewer, along the fold line 30 into juxtaposition with the right panel section 25 as in FIG. 2. Similarly, the left panel section 45 is folded rearwardly around the fold line 50 into juxtaposition with the left panel section 46 as illustrated in FIG. 2. The left panel 23 is positioned relative to the right panel 22 in a slight overlapping relationship with the right panel 22 along the edges 55 and 64 of the left panel and the edges 35 and 44 of the right panel. The two panels are sewn together along such overlapping edges slightly inwardly from the edges above and below the pocket panels 24 and 45. The resulting seam between the panel sections 25 and 46 produces narrow turned back edges 35*a* and 44*a* along the right panel above and below the pocket panel 24 with a similar width of the left panel 46 along the edges 55 and 64 overlapping the right panel the width of the narrow sections 35*a* and 44*a*. When the seam between the panels is complete, the narrow strips 35*a* and 44*a* may be pressed flat against the main portion of the panel 25. The back panel 21 is positioned as seen in FIG. 2 and sewn to the panel sections 24 and 45 as seen in FIG. 2. Seams are formed between corresponding edges of the panel 21 and the panel sections 24 and 45 of the right and left panels as follows: top edge 65 to top edges 31 and 54; sloping top edge 73 to sloping top edge 32; sloping top edge 66 to sloping top edge 53; vertical edge 72 to vertical edge 33; vertical edge 70 to vertical edge 52; and bottom edge 71 to bottom edges 34 and 51. The sewing of the pocket back panel 21 to the front pocket side panel sections 24 and 45 forms the pocket P along the inside back face of the lining assembly L. The right and left panels 25 and 46 are left unsewn or unattached along the vertical fold lines 30 and 50 thereby defining the opening O into the front of the pocket P along the length of the pocket between the pocket vertical front panel sections 24 and 45.

After completion of the pocket P as described and illustrated in FIG. 2, a vertical nylon fabric fastening strip 80 such as sold under the trademark Velcro, is attached by sewing along the front face of the left side panel section 46. Similarly, a fastening strip 81 is sewn along the inside or back face of the right inside pocket panel section 24. The strip 80 on the left panel section 46 is sewn along the edge of the panel at the fold line 50 so that the width of the fastening strip extends away from the fold line along the front panel face. The fastening strip 81 is sewn inward of the fold line 30, and thus, away from the edge of the panel 25 after the pocket panel 24 is folded back for assembly of the liner assembly L. This alignment of the fastener strips 80 and 81 provides an overlap between the edges of the right and left panels defining the opening O, so that when the opening is held closed by the fastener strips, it is essentially invisible to the observer looking at the inside of the coat lining.

Figure 4:
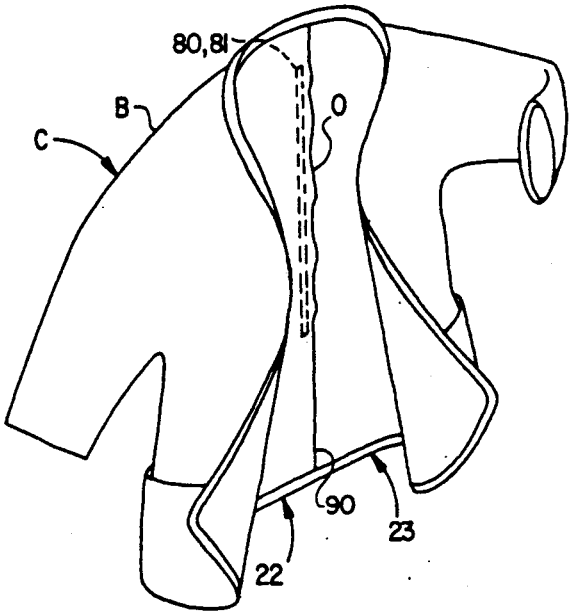
FIG. 4 is a front perspective view of a coat with the pocket and lining parts as seen in FIG. 3 installed in the coat.

The completed liner assembly L including the pocket P as illustrated in FIG. 3, is sewn into the body B of the coat C forming the back and side portions of the coat lining as illustrated in FIG. 4. The lining assembly L is attached to the remainder of the coat lining, not shown, formed of conventional lining panels which line the sides, front, shoulders, and sleeves of the coat. The lining assembly L is attached to the other conventional lining panel portions by sewing to such panel portions along the right and left panel edges, 40, 41, 42, 43, of the right panel 25, and the edges 60, 61, 62, and 63, of the left panel 46. The panel edges 43 and 63 will attach into the coat along and beneath the coat collar portion. The panel edges 42 and 62 generally will be attached to the other lining panels, not shown, beneath the connection of the coat sleeves into the body of the coat. The pocket P then lies along the back face of the lining within the coat body between the lining back and the inside of the coat shell or body, so that the pocket is fully hidden. The pocket opening O extends vertically in line with the center back seam 90, between panels 25 and 46. The Velcro strips 80 and 81 hold the opening O closed and essentially disguise the opening except when it is spread apart for folding and storing the coat.

Figure 5:
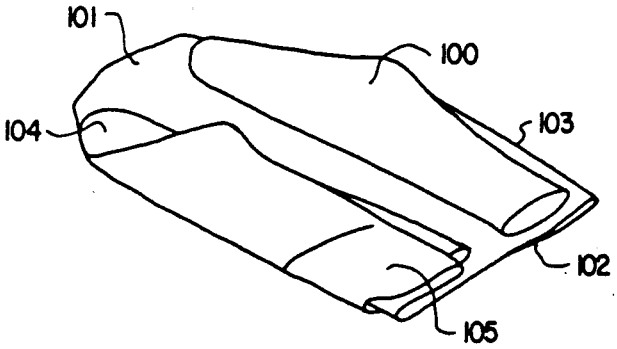
FIG. 5 is a back perspective view of the coat illustrating the beginning of the coat folding process as the coat would appear on a supporting surface, not shown, such as a floor or table, showing a first folding step of the right sleeve and shoulder lying along the back of the coat, and a second folding step of the left sleeve and shoulder and outer side of the coat folded over from the position of the right sleeve to lie longitudinally along the left back of the coat.
Figure 6:
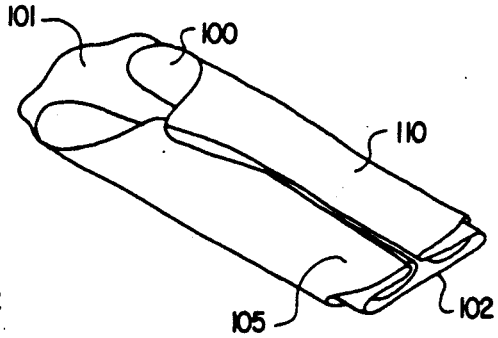
FIG. 6 is a back view in perspective of the coat as seen in FIG. 5 showing a fourth step of folding the right sleeve and shoulder and longitudinal right side of the coat over the back of the coat against the left sleeve and side.
Figure 7:
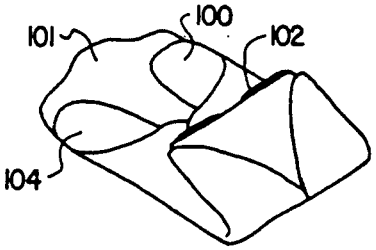
FIG. 7 is a back view in perspective of the coat with lower portions of the sleeves and body of the coat folded upwardly from the position of FIG. 6 to lie along the back of the coat.
Figure 8:
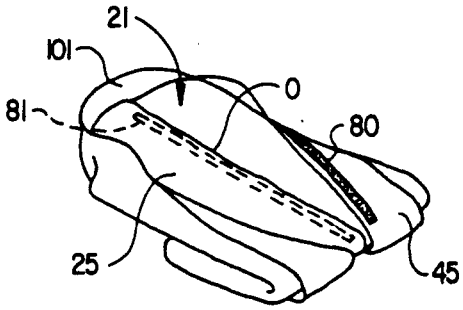
FIG. 8 is front perspective view of the coat turned over from the position illustrated in FIG. 7 and showing a right hand portion of the storage pocket partially open to begin the step of folding the coat into the pocket.
Figure 9:
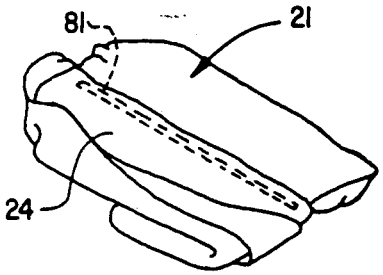
FIG. 9 is back perspective view of the coat at the position illustrated in FIG. 8 with the right half of the coat reversed folded into the lining pocket.
Figure 10:
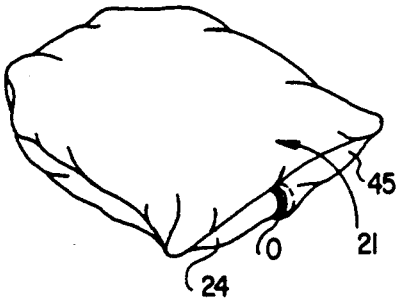
FIG. 10 is back perspective view of the coat as seen in FIG. 9 with the left half of the coat reversed folded into the pocket.

FIGS. 5–9 show a series of steps of folding the coat into the pocket P for convenient storage and travel. The coat is first placed on a flat surface such as a table or the floor, face down, with the front panels of the coat buttoned together as the coat is normally worn. A first sleeve of the coat, such as the right sleeve 100 as illustrated in FIG. 5, is folded downwardly along the back of the coat extending essentially from the collar area 101 to the bottom edge 102 of the coat along the right back side 103 of the coat. Next, the left sleeve 104 is similarly folded downwardly on the back left side of the coat to essentially the lower end edge 102 of the coat. The back quarter panel 105 of the coat is then folded over toward the back center line of the coat as illustrated in FIG. 5. The right back quarter panel 110 is then folded inwardly along the back of the coat toward the center line of the coat, as shown in FIG. 6, so that both sleeves and back side panels of the coat are folded together along the back of the coat. Approximately one third of the coat along the lower end portion is then folded upwardly against the back of the coat as illustrated in FIG. 7. The coat is then turned over to the position of FIGS. 8 and 9 exposing the lining along the fastened opening O. A portion of the collar end of the coat folded as in FIG. 8 is turned downwardly and under away from the opening. Any overlapping portions of the front of the coat which previously had been buttoned, are unbuttoned and turned back to fully expose the opening O. The Velcro strips are then pulled apart opening the opening O. One side of the coat, such as the right side visible in FIG. 8, is then grasped by both hands with the lining edge along the right Velcro strip manipulated away from the folder and the coat half turned inside out, so that the Velcro strip is moved around to the back side of the coat from the folder. Thus, one side of the coat is tucked or folded into the pocket with the other side remaining to be folded into the pocket. FIG. 9 shows the right side turned wrong side out into the pocket, while the left side remains to be turned. The left side then, similarly, is grasped by the hands of the folder and pulled around and over the left side of the coat which is tucked into the pocket so that the folded coat appears as shown in FIG. 10. The coat package is then turned over to the position of FIG. 11 and the Velcro strips are attached together and pulled to a smooth relationship leaving the coat body and lining fully packed within the lining pocket P. It will be recognized that when the coat is reverse folded into the storage pocket P, the inside surfaces of the panels forming the pocket become the outside of the storage bag or pocket P in which the coat is folded for travel and storage.

Figure 11:
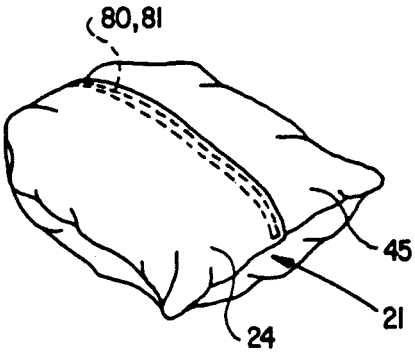
FIG. 11 is a front perspective view of the coat fully folded into the storage pocket with the folded coat turned over from the position of FIG. 10 showing the pocket opening fully closed.

In the fully packed state of the coat of FIG. 11, the coat may be readily placed in the overhead looker of an airplane, in a traveler's luggage, or may even serve a useful purpose as a pillow.

The coat is readily unpacked by pulling the Velcro strips apart along the opening and reversing the procedure of turning the coat wrong side out. Returning the coat to the wearing condition leaves the pocket fully concealed and the pocket opening O closed by the Velcro strips.

It will be recognized that coats constructed in accordance with the invention may be made of any desired material ranging from very light weight to heavy winter coats. They may be made of any desired length. The size and length of the pocket P, of course, can be made to conform to the bulk of the material and whether the coat is a long, short, or mid-length coat. One particular model of the coat made of mohair was found to satisfactorily store in the pocket for several days without adversely affecting the coat. It was readily wearable a short time after being unfolded.

What is claimed is:

1. A self-storing coat comprising:

a coat body;

a lining in said coat body including back panel portions along an inside back of said coat body;

a storage pocket attached with said lining back panel portions between said back panel portions and said coat body along a central portion of said back of said coat;

means along said lining back panel portions defining a vertical opening into said storage pocket extending along a back center line of said coat substantially the length of said storage pocket from the vicinity of the collar end of said coat toward the skirt end of said coat; and fastening means on said lining back panel portions along said opening for releasably securing said opening closed during wearing of said coat and during a storage mode of said coat when said coat and lining are folded into said storage pocket.

2. A coat according to claim 1 wherein said fastening means comprises fabric fastener strips attached with said lining back panel portions adjacent fabric edges of said panel portions defining said opening into said pocket.

3. A coat according to claim 2 including two said fastener strips, one of said strips being attached along an inside face of one panel of said lining back panel portions along one side of said opening into said pocket, and the other of said strips being attached along an outside face of another panel of said lining back panel portions along an opposite side of said opening, said fabric fastener strips being aligned along overlapping portions of said back panel portions along said opening for holding said opening closed along a back center line of said coat during wearing of said coat, and for holding said storage pocket closed when said coat is reversed folded into said storage pocket.

4. A coat according to claim 3 wherein each half of said coat and said lining of said coat is each reverse foldable into a half of said storage pocket positioned within said half of said coat whereby said pocket is turned inside-out and contains said coat and said lining of said coat and said pocket is held closed by said fabric fastener strips, and the normal inside fabric surfaces defining said pocket when said pocket is not in use and said coat is worn forming outside surfaces of said pocket when said coat is reversed folded into said pocket and said pocket is held closed by said fabric strips.

5. A coat according to claim 4 wherein said storage pocket is formed by a back panel extending the full length and width of said storage pocket and by front panel portions each defining a longitudinal front half of said pocket on opposite sides of said opening.

6. A coat according to claim 5 wherein said front panel portions are each an integral part of an adjacent lining panel defining one half of a back and a portion of a side of said lining of said coat, and each said front panel portion of said storage pocket is folded back in juxtaposition with said adjacent lining panel of which said front panel portion is a part.

7. A self storing coat having a body defining a back, sides, and front of said coat, and a lining in said body having a back, side, and front panel portions;

said back panel portions of said lining being sewn together along a vertical back center line of said lining in said coat along an upper portion and along an lower portion of said center line, and being left unattached along a portion of said center line whereby edges of said back panel portions unattached along said center line define an opening through said back panel portions;

a storage pocket within said coat body along a central back portion of said coat body between an inside face of said back portion of said coat body and said back panel portions of said lining, said opening defined in said back panel portions being substantially equal to the length of said pocket and leading into said pocket;

said storage pocket being defined by a back panel extending the full length and width of said storage pocket and by front side panel portions along each side of said opening, said front side panel portions being defined by folded-back parts of lining back panels along each side of said vertical center line each of said front pocket panel portions defining a vertical front half of said pocket, the peripheral edges of said pocket front panel portions along the sides, top, and bottom of said pocket front panel portions being sewn to corresponding top, bottom and side edges of said pocket back panel;

a fabric fastening strip attached along one of said pocket front panel portions adjacent to said vertical opening into said pocket;

and a second fabric fastening strip being attached to one of said lining back panels along a front face of said panel adjacent to said opening into said pocket;

said first and second fabric fastening strips being aligned to fasten together to hold said opening into said storage pocket closed along said vertical center line of said coat and said lining for wearing said coat and said fabric fastening strips holding said storage pocket closed when said coat is reversed folded into said storage pocket;

and said storage pocket being sized in relation to said lining and said coat body whereby halves of said coat and said lining are foldable and reversible into said pocket through said opening by turning said pocket wrong-side out and folding said coat and lining halves into said pocket for storing said lining and said coat and body within said pocket with the normal inside fabric surfaces defining said pocket forming outside surfaces of said pocket when said pocket is turned wrong-side out and containing said coat body and lining, and said fabric fastening strips attaching together to close said pocket over said reversed folded coat when said coat and lining are in a storage mode within said storage pocket.

* * * * *